US005251467A

United States Patent [19]

Anderson

[11] Patent Number: 5,251,467

[45] Date of Patent: Oct. 12, 1993

[54] FRONT-INSTALLED CAM LOCK

[75] Inventor: Victor R. Anderson, Trumbull, Conn.

[73] Assignee: Loctec Corporation, Newtown, Conn.

[21] Appl. No.: 941,912

[22] Filed: Sep. 8, 1992

[51] Int. Cl.[5] ..... E05B 9/08

[52] U.S. Cl. ..... 70/370; 70/370; 70/451; 70/466; 411/508; 411/913

[58] Field of Search ..... 70/451, 452, 466, 370, 70/DIG. 40; 292/DIG. 53; 411/508, 510, 913; 403/252, 289, 407.1

[56] References Cited

U.S. PATENT DOCUMENTS

| | | | |
|---|---|---|---|
| Re. 22,544 | 9/1944 | Tinnerman | 411/913 |
| 2,093,038 | 9/1937 | Douglas | 70/370 |
| 2,632,615 | 3/1953 | Churchill | 411/508 |
| 3,842,709 | 10/1974 | Fuqua | 411/508 |
| 4,080,522 | 3/1978 | Schimmels | 411/510 |
| 4,381,656 | 5/1983 | Hayakawa | 70/370 |

FOREIGN PATENT DOCUMENTS

| | | | |
|---|---|---|---|
| 1518334 | 7/1978 | United Kingdom | 70/451 |

*Primary Examiner*—Peter M. Cuomo

*Assistant Examiner*—Darnell Boucher

*Attorney, Agent, or Firm*—Haynes N. Johnson

[57] ABSTRACT

A lock for front-mounting through a panel opening in a panel, the lock having a face plate, a barrel extending transversely from the face plate, and a shaft extending from the barrel to receive a cam. The lock has a retaining spring with a base and two legs, the base and legs being formed of spring steel and being integral with one another, the base having a central opening receiving the shaft and being so dimensioned as to be able to pass through the panel opening when the base is mounted on the shaft, each of the legs having two sides of different lengths so that the outer ends of the legs are angular. The legs extend generally transversely of the base with the outer ends being spaced apart a greater distance than the size of the panel opening, so that when the lock is pressed through the panel opening the face plate will engage with one side of the panel and the outer ends will engage with the other side of the panel, securing the lock in position. Modifications include the use of a U-shaped base which can be slipped into a slot on a unit to be installed, and having a separate, barbed base for each leg, the base fitting into and locking in a slot.

19 Claims, 2 Drawing Sheets

FRONT-INSTALLED CAM LOCK

FIELD OF THE INVENTION

This invention relates to the field of cam locks used for filing cabinets and other end use applications, and, in particular, it relates to locks which can be installed from the front of a panel, such as a cabinet panel, without reaching behind the panel.

BACKGROUND OF THE INVENTION

In the past, cam locks have been installed in file cabinets and other metal cabinets in one of two ways. The first would be to insert the lock through a hole in the front of the panel, and then reach behind and slip a fork clip into fork clip slots in the lock to hold it in place. If the lock was single cam, the cam could be pre-installed and also slipped through the hole. If double cam (two cams at 90 degrees from one another), such could not fit through the panel opening and would have to be attached from the rear with a Keps nut (combined nut and lockwasher) or a Sems screw. This system required considerable work behind the panel, was expensive, and often resulted in cut fingers, in addition to low employee morale.

An improvement on this system was developed about twenty years ago, and eliminated the use of fork clips. A spring retaining clip had a split circular band at its inner end and two spring ears flaring outwardly towards the panel. The band fit into a peripheral channel formed about the lock cylinder near its inner end. When the cam lock was inserted through the hole, the ears were pressed inwardly to fit within the hole, and, after the lock was fully in position, they snapped out, pressing against the inner surface of the panel to hold the lock in place. This represented an improvement and, with single cam locks, allowed full installation from the front. With double cam locks, the cam still had to be installed from the back as before.

This improvement had drawbacks, however. The band had to be opened up to be assembled in the channel. Sometimes it didn't completely close and thus did not fit tightly around the body of the lock. Sometimes, it would hook when the lock was inserted through the panel. Further, it required a longer lock body to provide space for the channel, adding cost and making it unusable in shallow places.

BRIEF SUMMARY OF THE INVENTION

My invention uses a new retaining spring in association with a redesigned lock body. The spring has the appearance of a thin, flat washer (the base) with two ears (legs) extending from it and angling slightly outwardly from an axial direction. It is made from a single piece of spring steel. Instead of having a band fitting around the lock cylinder, the base of the retaining spring is planar and fits about the lock shaft and, because it is thin, it requires an axial distance which is but the thickness of the base. Thus, the cylinder can be shorter and still accommodate the retaining spring. Spacers can be placed between the washer and the end of the cylinder and/or between the washer and the cam arms to adjust the axial position of the retaining spring. Consequently, one size retaining spring can be used for most installations.

The two legs on the spring are similar to one another, but one side of each of the legs is shorter than the other side, resulting in an angular end; and the short side is bent outwardly. As with the prior retaining spring which had a band, the legs snap outwardly upon installation. Since the end of the leg is angular, any portion of it can lock by pressing against the edge of the hole. By adding teeth (serrations) to the end of the leg, one of the teeth will lock against the edge, providing for a more secure and tighter fit. The use of teeth also makes the spring work better with panels of different thicknesses.

The cost of the old lock with the wrap-around band for the retaining spring is more than my new one, because, since the new retaining spring requires no band, the lock itself can be made shorter and the retaining spring can be made less expensively. Further, a lock with the new spring requires less labor for installation. These features create savings which are important in this cost-conscious industry.

A modified retaining spring of my new type can also be used for other types of installations. One use, for example, is to hold a unit such as a push button or meter in place on a panel. Here, a slit runs around the body of the unit at the proper distance from the panel, and the base of the spring is flat, as before, but now it is U-shaped. The spring is slipped into position in the slit by sliding it from one side, and the unit is inserted in an opening in the panel as before.

In a further modification the U-shaped portion can be eliminated and each leg made as a separate piece with its own base portion. The base is barbed so that, when it is pressed into a slit on the unit, it locks in place.

DETAILED DESCRIPTION OF THE INVENTION

Figure 1:
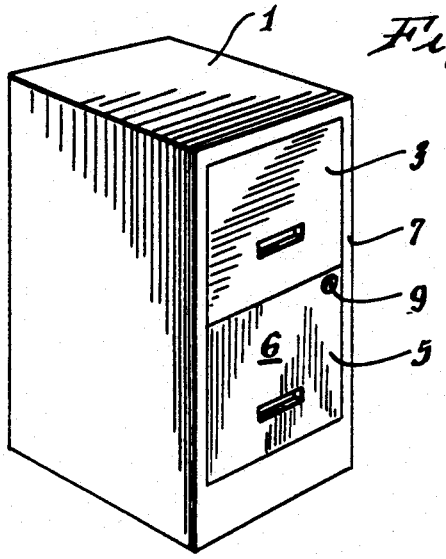
FIG. 1 is a perspective view of a filing cabinet showing a typical installation.
Figure 3:
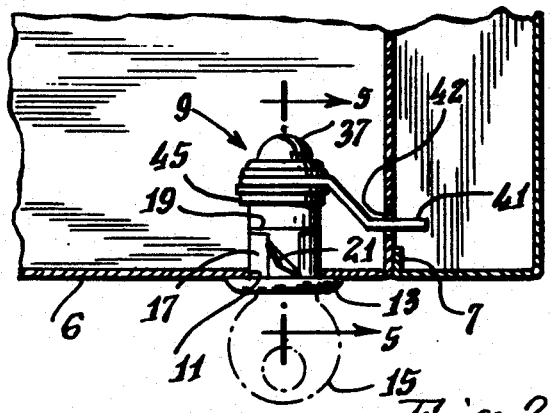
FIG. 3 is a section taken on line 3—3 of FIG. 2 showing locking of the lower drawer.
Figure 4:
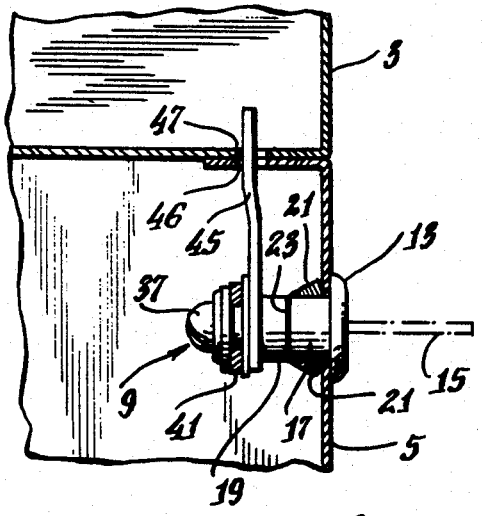
FIG. 4 is a section taken on line 4—4 of FIG. 2 showing locking of the upper drawer.
Figure 2:
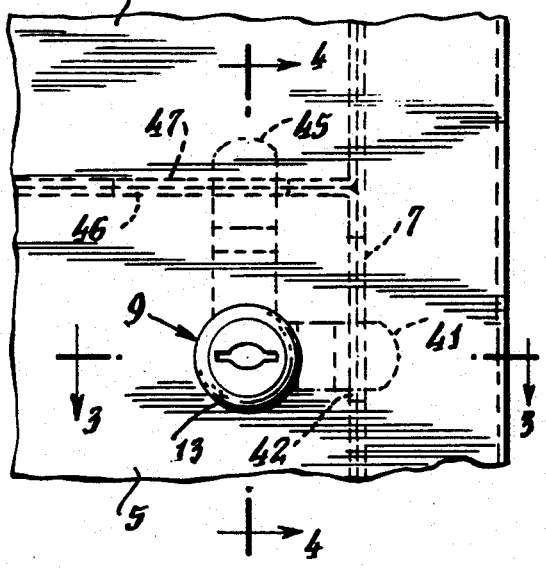
FIG. 2 is a front elevation showing the installed lock in its locked position. This particular lock is shown with an L-lever double cam which serves to lock two drawers.

Cam locks are often used on file cabinets 1 having, say, two drawers, an upper drawer 3 and a lower drawer 5, with side members 7. A low cost of manufacture is critical for many such file cabinets.

The lock 9 itself is often installed in the upper right corner of the face 6 of lower drawer 5.

Face 6 has an opening 11 to receive lock 9. The opening normally has a double-D shape (i.e., round with opposite sides flattened) so that the lock can not rotate in the opening. The lock itself has an outer face plate 13, wider than the opening, which fits against the outer surface of face 6. It has a barrel 17 with a complementary double-D cross-section which passes through opening 11. The barrel is narrowed at shoulder 19 to the width of rotating shaft 20.

Retaining spring 21 is made of spring steel and includes a washer-like, planar base 23 with a rim 22 and an opening 24 in it so that it can fit about shaft 20. The outer periphery of rim 22 is preferably smaller than opening 11, or so dimensioned that, when mounted on a lock, it can pass through the opening. Two integral legs 25, made of the same piece of spring steel, extend generally transversely from the base, but at a slight angle such that they extend slightly away from the axis of the spring (as in the earlier type of retaining spring). The two legs 25 are identical, and each leg has sides of different lengths to provide an angular outer end 27 for the leg. The shorter leg is bent so that it extends farther outwardly (away from the axis). The lock, when mounted, is secured in position by having the portions of face 6 which form the edges or periphery 12 of opening 11 held firmly between lock face plate 13 and the angular ends 27 of legs 25. Legs 25 are dimensioned such that their angular ends 27 will abut the edges of opening 11; and the legs have their longer edges innermost.

Retaining spring 25 is fitted about shaft 20 and against shoulder 19, with the plane of its base 23 transverse to the axis of the shaft. Alternatively, in order to adjust the final position of the ends 27 of legs 25, one or more washers or spacers 33 and 35 may fit about shaft 20 between spring base 23 and shoulder 19.

I have found that a satisfactory retaining spring can be made of spring steel which is 0.5 mm thick with the sides of each leg being 8.8 mm (0.340") and 10.2 mm (0.400"), with the shorter side of each leg being bent slightly outwardly, i.e., in a direction away from the other leg. The differences between the 0.340" and 0.400" dimensions will allow and accomodate different double-D hole material thickness to a small degree, such as ±0.040". Beyond this range, spacers can be used for adjustments.

One or more cams 41 and 45 are fitted on the inner end of shaft 20; and the retaining spring, spacers, and cams are held in place by screw 37 which fits within the inner end of shaft 20. Instead of using a screw, the elements can be held in place with a Keps nut, a hex nut, or spin on. If only a single short cam 41 is used, it will serve to lock the lower drawer 5 when shaft 20 is rotated such that cam 41 passes through slot 42 in the side of lower drawer 5 and fits within slot 43 in side member 7. This will prevent the drawer from being opened.

A second cam, long cam 45, can also be mounted on the shaft 20 if it is desired to lock the upper drawer. The long cam 45 is perpendicular to short cam 41. When the shaft is rotated to lock the lower drawer, long cam 45 will pass through slot 46 in the upper surface of drawer 5 and into a slot 47 in the bottom of the upper drawer 3.

If a single cam is used, it can be inserted through the panel opening 11 in face 6 when the lock is being installed from the front. Thus, the lock and cam can be pre-assembled. If, however, two perpendicular cams are being used, they will not fit through the panel opening. In such case, the past practice has been to have the two cams made up as a single L-shaped piece which has had to be installed from the back after the lock itself has been mounted.

I have discovered, however, that it is possible to have two cams and still pre-assemble the entire unit before installation. This is done by initially making the unit with the cams overlapping (so they act as a single cam during installation), and making the second cam such that it can, after installation, be rotated ninety degrees relative to the first cam and lock itself in position. Then, the two-cam lock can be installed from the front, and the only work that needs to be done inside the unit after installation of the lock is a simple rotation of the second cam into position. This two-cam structure is the subject of patent application being filed by me concurrently.

Installation of the lock with my new retaining spring is done in the same manner as has been done with the former type of retaining springs. The cam and barrel of lock 9 is inserted through opening 11 in face 6. Since the normal position of the legs 25 of the retaining spring 21 is such that the distance between the outer ends of the legs is greater than the diameter of opening 11, pressing the lock into place will cause the legs to be compressed inwardly until the lock is in place, at which time they will snap outwardly, The portions of face 6 abutting opening 11 will then be held between face plate 13 and the angular ends 27 of the legs 25.

Figure 5:
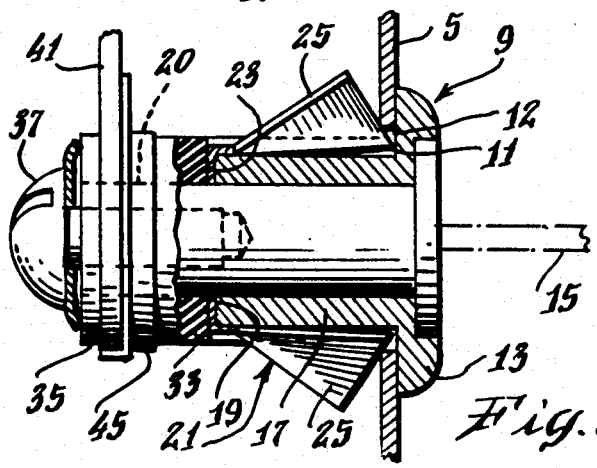
FIG. 5 is a section taken on line 5—5 of FIG. 3 showing the retaining spring securing the lock in place.
Figure 6:
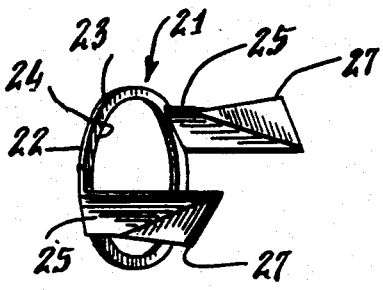
FIG. 6 is a perspective view of the retaining spring.
Figure 7:
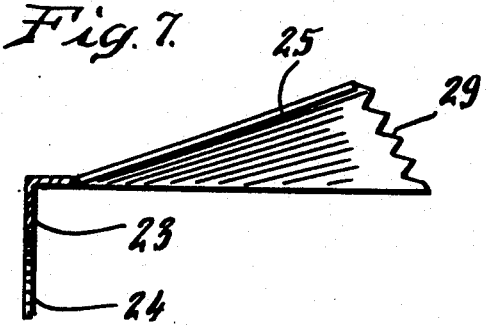
FIG. 7 is an enlarged view of a portion of a retaining spring showing serrated edges on the ends of the legs.

It will be noted that, due to the angularity of the ends, the legs will spring to a position providing for the tightest grip (See FIG. 5). If desired, the ends 27 can be serrated or toothed, as shown in FIG. 7. This will cause the ends to lock into position and also allows for variations in thickness of face 6.

It should be noted that my design for the lock and the retaining spring permits the total length of the lock to be less, since length does not have to be provided, as in the prior art, for a channel to receive the band of the retaining spring. Instead of a wide band to hold the retaining spring in place, my spring is held in place by its thin base 23. This makes the lock more compact so that it can fit into smaller space, but it also reduces the material and labor cost of making the longer lock.

It should also be noted that my design permits the use of a single size retaining spring 21 for all installations, since the distance of the angular ends 27 from the face plate 13 can be adjusted as desired by the use of spacers 33 and 35, the spacers being placed on one side or the other of the base 23, or one or more on both sides, as may be desirable.

Figure 8:
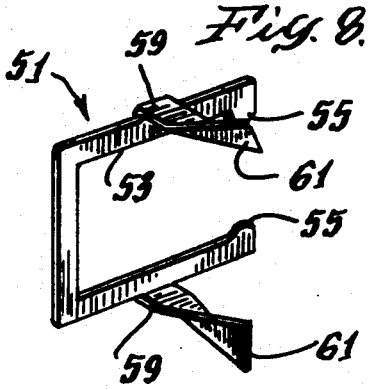
FIG. 8 is a perspective view of a modified form of retaining spring.
Figure 9:
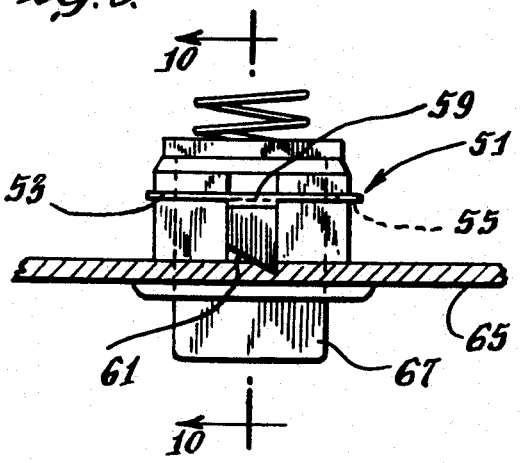
FIG. 9 is a view showing a push button being held in place in a panel by the modified retaining spring.
Figure 10:
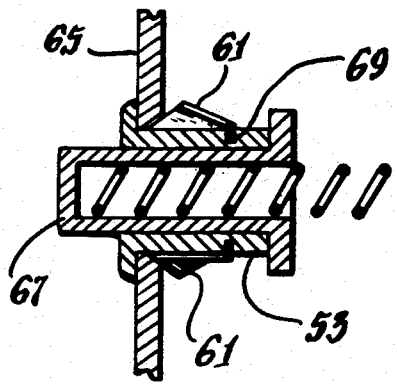
FIG. 10 is a section taken on line 10—10 of FIG. 9 showing how the modified spring holds the push button in place in a panel.

This idea of having a planar base of spring steel, with its concomitant thinness can be adapted to other uses also. As seen in FIGS. 8 to 10, a modified retaining spring 51 can be made with a U-shaped base 53 with inwardly-extending holding detents 55 at ends of the arms of the U. As before, spring 51 has legs 59, formed from the same piece of spring steel, and extending to angular ends 61. The base 53 must, of course, be smaller than the opening through which the unit will be inserted.

This retaining spring 51 can be used to hold instruments or other devices to a panel 65, or could be used for locks if desired. Thus, for example, it could hold a control button 67 in an opening in panel 65 in the same manner as with the locks. Here, however, since there is no shaft for the base to fit about, a peripheral slot 69 is formed in the button at the right distance, and the U-shaped base 53 of the retaining spring 51 slipped into the slot, the unit being held in place by the detents 55. The button is then installed in the panel in the same manner as a lock is installed.

Figure 11:
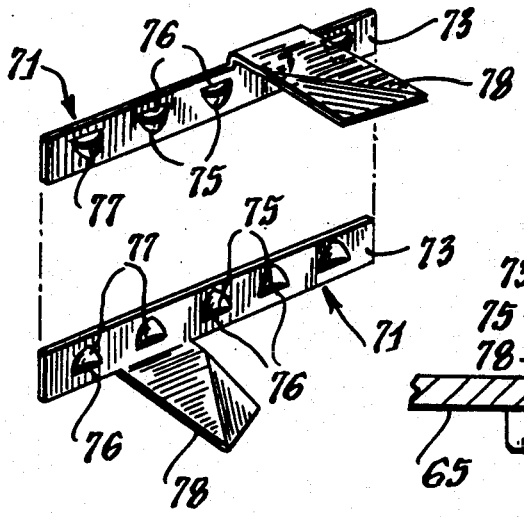
FIG. 11 shows a further modification in which each leg has its own base. The two legs are shown in the relative positions they would be in if one base had been inserted into a slit on one side of a unit to be installed (such as a push button), and the other base had been inserted into a slit on the other side of the unit.
Figure 12:
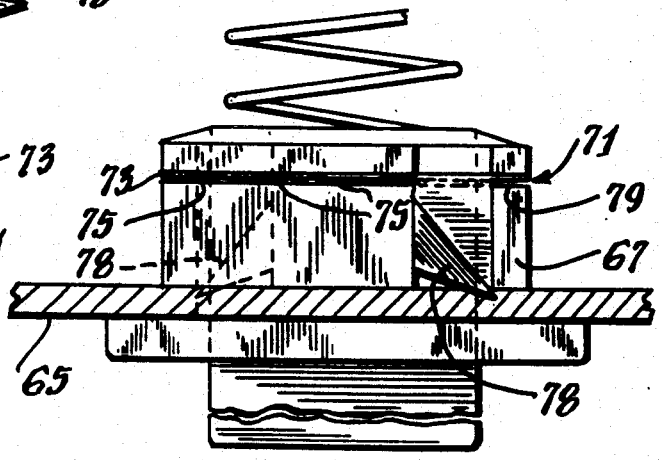
FIG. 12 shows this further modification being used to hold a push button in place on a panel.

A further modification of my spring can be seen in FIGS. 11 and 12. Here, each leg 78 has its own planar base 73 which fits into a slot 79. The base is integral with the leg, both of which are made of spring steel, the base being substantially perpendicular to the leg. The base 73 has been formed with a plurality of evenly spaced barbs 75, which serve to lock the base 73 in the slot 79. The barbs can be formed by punching out small slits 76 in the base and bending the adjacent portion 77 outwardly, the bent portion then forming the barb 75.

Slot 79 is similar to slot 69, except that, depending upon particular design parameters, the slot will normally run on only two opposite sides of the unit being installed. The two sides of each leg are of different lengths, as before, with the shorter side again being bent outwardly.

I claim:

1. In a lock adapted for front-mounting through a panel opening in a panel, said lock having a face plate, a barrel extending transversely therefrom, and a shaft extending from said barrel to receive a cam, that improvement including a retaining spring including a planar base and two legs, each having a length and a width said base and legs being formed of spring steel and being integral with one another only at the end of said legs which contacts said base, said legs having as outer ends the ends thereof most removed from said base, said base having a central opening receiving said shaft, said base being so dimensioned as to be able to pass through said panel opening when said base is mounted on said shaft, each of said legs having two edges opposite to one another, said edges being of substantially equal length, one of said edges of each leg being angled along a portion of its length to create edges having different effective lengths whereby said outer ends of said legs are not perpendicular to said edges, said legs extending generally transversely to the plane of said base with the outer ends thereof being spaced apart a greater distance than the size of said panel opening, whereby when said lock is pressed through said panel opening said face plate will engage with one side of said panel, said legs will pass entirely through said panel, and said outer ends will engage with the other side of said panel, thereby securing said lock permanently in a fixed position relative to said panel.

2. In a lock as set forth in claim 1 that improvement in which said shorter side of each said leg, proximate to its said outer end, is bent in a direction away from said barrel, so said shorter side of each said leg will be farther removed from said barrel than said longer side of said same leg.

3. In a lock as set forth in claim 2 that improvement in which said outer ends are serrated to provide improved gripping of said panel.

4. In a lock as set forth in claim 1 that improvement including at least one spacer on said shaft, said spacer abutting said base.

5. A retaining spring for securing a front-mounted unit in a panel opening in a panel, said retaining spring including a planar base and at least two legs, said base and legs each having a length and a width being formed of spring steel and being integral with one another at, and only at, one end of each of said legs, said base having a central opening to receive a front-mounted unit, and having a rim about said central opening, said rim being so dimensioned as to be able to pass through said panel opening when said base is mounted on said front-mounted unit, each of said legs having two edges opposite to one another, said edges being of substantially equal length, one of said edges of each leg being angled along a portion of its length to create edges having different effective lengths whereby the outer ends of said legs are not perpendicular to said edges, said legs extending generally transversely to the plane of said base with the outer ends thereof being spaced apart a greater distance than the size of the panel opening, whereby said retaining spring can be used in the insertion through the panel opening of a front-mounted unit with said outer ends pressing against the panel and the permanent retention of the front-mounted unit in the panel in a fixed position.

6. A retaining spring as set forth in claim 5 in which said shorter side of each said leg, and only the shorter side, is bent in a direction away from the other said leg.

7. A retaining spring as set forth in claim 5 in which said outer ends of said legs are serrated.

8. A retaining spring as set forth in claim 5 in which said planar base is U-shaped with inwardly projecting detents therein, said detents lying in the plane of said base.

9. A retaining spring as set forth in claim 5 in which said base includes a rim completely surrounding said central opening.

10. A lock adapted for front-mounting through a panel opening in a panel, said lock including a face plate, a barrel extending transversely therefrom, and a shaft extending from said barrel, a shoulder on said barrel proximate to said shaft, a retaining spring including a planar base and two legs, each having a length and a width said base and legs being formed of spring steel and being integral with one another, said legs having as outer ends the ends thereof most removed from said base, said base having a central opening receiving said shaft, said base being so dimensioned as to be able to pass through said panel opening when said base is mounted on said shaft, each of said legs having two edges opposite to one another, said edges being of substantially equal length, one of said edges of each leg being angled along a portion of its length to create edges having different effective lengths whereby said outer ends of said legs are not perpendicular to said edges, said legs extending generally transversely to the plane of said base with the outer ends thereof being spaced apart a greater distance than the size of said panel opening, and said legs being twisted such that the shorter legs are outermost, whereby said lock can be pressed through a panel opening and said face plate will engage with one side of said panel and said outer ends will engage with the other side of said panel, thereby permanently securing said lock in a fixed position relative to said panel.

11. A lock as set forth in claim 10 in which said outer ends of said legs are serrated.

12. A retaining spring as set forth in claim 10 in which said base includes a rim completely surrounding said central opening.

13. A lock as set forth in claim 10 including a spacer on said shaft, said spacer abutting said base.

14. A retaining spring for use in securing a front-mounted unit in a panel through an opening in said panel by pressing said unit in an axial direction through said opening, said retaining spring including a planar base and means for securing said base to said unit with the plane of said base transverse to the axis of said unit, at least one leg integral with said base and secured to said base only at the end of said leg, said leg having a length and a width said leg and said base being formed of spring steel, and said leg being substantially transverse to the plane of said base, said leg having two opposite edges of substantially equal length not attached to said base, one of said edges of said leg being angled along a portion of its length to create edges such that one said edge is effectively shorter than the other said edge so the end of said leg is not perpendicular to said edges, said angled edge, and only said angled edge, being bent outwardly away from said axis when said base has been secured to said unit, whereby the end of said leg can press against the inside of said panel to hold said unit permanently in a fixed position on said panel.

15. A retaining spring as set forth in claim 14 including at least two said legs and in which said securing means is an opening in said base permitting said base to fit about said unit.

16. A retaining spring as set forth in claim 15 in which said opening is U-shaped.

17. A retaining spring as set forth in claim 15 in which said opening is entirely enclosed by a rim.

18. A retaining spring as set forth in claim 14 in which said securing means includes at least one barb projecting from said base.

19. A retaining spring as set forth in claim 13 in which the end of said leg which is most removed from said base is serrated.

* * * * *